US010434544B2

(12) United States Patent
Mayer et al.

(10) Patent No.: US 10,434,544 B2
(45) Date of Patent: Oct. 8, 2019

(54) METHOD FOR PRODUCING A COATING CONSISTING OF SURFACER AND TOPCOAT

(71) Applicant: BASF Coatings GmbH, Muenster (DE)

(72) Inventors: Bernd Mayer, Muenster (DE); Andreas Hanning, Duelmen (DE); Meinolf Sendker, Muenster (DE); Carsten Vietze, Drensteinfurt (DE); Reinhard Wiesing, Muenster (DE)

(73) Assignee: BASF Coatings GmbH, Muenster (DE)

( * ) Notice: Subject to any disclaimer, the term of this patent is extended or adjusted under 35 U.S.C. 154(b) by 0 days.

(21) Appl. No.: 15/742,114

(22) PCT Filed: Jul. 15, 2016

(86) PCT No.: PCT/EP2016/066983

§ 371 (c)(1),
(2) Date: Jan. 5, 2018

(87) PCT Pub. No.: WO2017/013041

PCT Pub. Date: Jan. 26, 2017

(65) Prior Publication Data

US 2018/0200757 A1 Jul. 19, 2018

(30) Foreign Application Priority Data

Jul. 21, 2015 (EP) ..... 15177765

(51) Int. Cl.
*B05D 7/00* (2006.01)
*B05D 7/14* (2006.01)
*B05D 1/04* (2006.01)

(52) U.S. Cl.
CPC ..... *B05D 7/542* (2013.01); *B05D 1/04* (2013.01); *B05D 7/14* (2013.01); *B05D 7/544* (2013.01); *B05D 7/587* (2013.01); *B05D 2350/00* (2013.01); *B05D 2350/60* (2013.01); *B05D 2401/10* (2013.01); *B05D 2401/20* (2013.01); *B05D 2401/21* (2013.01); *B05D 2401/50* (2013.01); *B05D 2451/00* (2013.01)

(58) Field of Classification Search
CPC ..... B05D 7/14; B05D 7/544; B05D 2350/00; B05D 2350/60; B05D 2461/10; B05D 2401/20; B05D 2401/21; B05D 2401/50
USPC ..... 427/372.2, 384, 388.1, 407.1, 409
See application file for complete search history.

(56) References Cited

U.S. PATENT DOCUMENTS

| | | | | |
|---|---|---|---|---|
| 5,330,796 | A | 7/1994 | Kasari et al. | |
| 5,366,768 | A | 11/1994 | Kasari et al. | |
| 2003/0072943 | A1* | 4/2003 | Anderson | B05D 7/57 428/411.1 |
| 2007/0082211 | A1* | 4/2007 | Hazan | B05D 7/572 428/500 |
| 2007/0098926 | A1* | 5/2007 | Uhlianuk | B05D 7/572 428/31 |
| 2007/0110902 | A1* | 5/2007 | Johnson | B05D 7/14 427/372.2 |
| 2007/0190311 | A1* | 8/2007 | Hazan | B05D 7/14 428/323 |
| 2007/0190312 | A1* | 8/2007 | Hazan | B05D 7/14 428/323 |

FOREIGN PATENT DOCUMENTS

| | | | |
|---|---|---|---|
| DE | 19948005 | A1 | 5/2001 |
| EP | 0 512 562 | A2 | 11/1992 |
| EP | 0 513 814 | A1 | 11/1992 |
| JP | 55-82167 | | 6/1980 |
| JP | 59-183867 | | 10/1984 |
| JP | 8-294662 | | 11/1996 |
| JP | 2000-70833 | A | 3/2000 |
| JP | 2002-254025 | A | 9/2002 |
| JP | 2003-164803 | | 6/2003 |
| JP | 2004-33845 | | 2/2004 |
| JP | 2005-177541 | | 7/2005 |
| JP | 5324715 | | 8/2014 |
| WO | 2015/090799 | A1 | 6/2015 |
| WO | 2015/090814 | A1 | 6/2015 |

OTHER PUBLICATIONS

Ansdell, D.A. Automotive Paints. In Paint and Surface Coatings: Theory and Practice, 2nd Edition; Lambourne, R. and Strivens, T.A ., Ed.; Woodhead Publishing Ltd: Cambridge, 1999; p. 440. (Year: 1999).*

International Search Report dated Oct. 14, 2016, in PCT/EP2016/066983, filed Jul. 15, 2016.

Japanese Office Action issued in patent application No. 2018-503244 dated Jan. 25, 2019 with English translation (7 pp.).

Japanese Office Action issued in patent application No. 2018-503239 dated Jan. 16, 2019 with English translation (8 pp.).

Russian Search Report issued in patent application No. 2018106331 dated Dec. 24, 2018, 2 pp.

(Continued)

*Primary Examiner* — William P Fletcher, III

(74) *Attorney, Agent, or Firm* — Oblon, McClelland, Maier & Neustadt, L.L.P.

(57) ABSTRACT

Provided is a method for producing a coating that includes a surfacer coat and topcoat on a substrate and including applying a first coating material to an untreated substrate or a substrate coated with a cured electrodeposition coat, and applying a second coating material to the surfacer coat. The produced coating system is cured to form the coating. The first and second coating materials are compatible according to DIN EN ISO 12944-5:2008-01, and the second application takes place before the first coating material has reached drying stage 1 according to DIN 53150:2002-09, and the drying stage is determined according to EN ISO 9117-3: 2010. The method is suitable for producing coatings on automobiles and commercial vehicles, such as trucks, vans, and buses.

15 Claims, No Drawings

(56) References Cited

OTHER PUBLICATIONS

Russian Search Report issued in patent application No. 2018106328 dated Nov. 27, 2018, 2 pp.
A. D. Akovlev "Himia I tehnologia lakokrasocnyh pokrytij", Leningrad, "Himia", 1981, pp. 300-304 (RU), 7pp.
English translation of the Japanese Office Action dated Jun. 20, 2019 in Patent Application No. 2018-503244, citing documents AO-AT therein, 13 pages.

* cited by examiner

METHOD FOR PRODUCING A COATING CONSISTING OF SURFACER AND TOPCOAT

The present invention relates to a method for producing a coating consisting of a surfacer coat and topcoat on a substrate, and also to a substrate coated by the method of the invention. The substrate preferably comprises the body or the cabin of a motor vehicle, or a constituent thereof. The method of the invention is suitable especially for producing coatings on automobiles and commercial vehicles, such as trucks, vans, or buses.

Known from the prior art is the coating of bodies or cabins of motor vehicles customarily in a multistage process, resulting in a multicoat paint system. These known finishing processes customarily have the following steps:

1) phosphating of the substrate;
2) application of a cathodic electrocoat and curing of the electrocoat, resulting in a corrosion control electrocoating;
3) application of a coating material to form a surfacer coat. The application is made customarily in two spray passes. Following application, the resulting surfacer coat is first flashed off (flash-off time) and then cured thermally (at 60 to 150° C., for example) to form a cured surfacer coat. Typical film thicknesses of the cured surfacer coat are between 30 μm and 80 μm. Latter film thicknesses are used if sanding of the cured surfacer coat is intended;
4) a) application of a coating material for forming a single-coat topcoat. The application takes place customarily in at least two spray passes. Coating materials for forming single-coat topcoats are usually of single-color pigmentation. Following application, the resulting topcoat is first flashed off and then cured thermally. Typical film thicknesses of the cured topcoat, depending on hue and hiding power, are between 50 and 80 μm.
   b) Alternatively to a), the application of a coating material for forming a basecoat, with subsequent application of a coating material for forming a clearcoat, may also be carried out. The basecoats are flashed off prior to the application of the coating material for forming the clearcoat, and reach film thicknesses of about 10 to 20 μm. In relation to the flash-off times, the general rule is that an extension to the flash-off time results in improved appearance of the clearcoat over it. After a corresponding flash-off time, a coating material for forming a clearcoat is applied. This clearcoat is optionally flashed off and then cured thermally. Typical film thicknesses for the cured clearcoat are approximately 50 μm.
5) Alternatively to the combination of sections 3 and 4a, topcoats are also applied directly, i.e., without cured surfacer coat, to the cured cathodic electrocoat. The absent cured surfacer coat, however, makes it possible for UV rays to be transmitted, for example, which can lead to chalking of the cured electrocoat and to loss of adhesion. An increase in the amount of UV absorbers would result in significantly higher costs of material. Where a variety of substrates or different substrates are employed, it is necessary to apply a significantly higher film thickness to obtain the desired coverability, especially in the case of hues with poor hiding power. For high-quality applications, this option is ruled out on grounds of quality and/or cost.
6) Alternatively to the combination of sections 3 and 4a, "integrated" finishing processes are used, in which the properties of the cured surfacer coat are achieved through application of a first basecoat. In these integrated processes, applied first of all is a coating material for forming the first basecoat, which comprises, for example, no effect pigments, but instead has additional functional fillers. This first basecoat is optionally flashed off before a coating material for forming a second basecoat is applied. The dry film thickness of the first basecoat is about 20 μm. This is followed by the application of a further coating material for forming a second basecoat. This coat is used for setting the hue. The dry film thickness of this second basecoat is customarily less than 20 μm. Following application of the second coating material for forming the second basecoat, the first and second basecoats are flashed off in a flash-off zone at least to a dust-dry state. This is followed by the application of an unpigmented coating material to form a clearcoat. This coat is optionally flashed off in turn, prior to the concluding thermal curing of this coat.

The coating materials used in the steps described above comprise in principle a plurality of constituents: binders, pigments and fillers, and also solvents, with possible additives included among the binders, depending on the definition of the term "binder". Binders are in principle responsible for forming a crosslinked film on a substrate. The term "main binder" refers to the binder constituent that is primarily responsible for forming a crosslinked film. Coating materials may in principle be physically curing, self-crosslinking, or externally crosslinking. Generally speaking, coating materials are divided into one-component systems (1-K) and two-component systems (2-K). 2-K systems are all those coating materials to which a crosslinker component must be added shortly before processing in order to cure the coating material. The remaining coating materials, to which no crosslinker component will be added shortly before processing in order to cure the coating material, are referred to as 1-K systems. In the case of two-component coating materials, both the component to be crosslinked and the corresponding crosslinker form the main binder.

In relation to the solvent, the possibility that generally exists is for the coating materials to be substantially solvent-based or substantially aqueous.

A feature common to the above-described coating methods from the prior art for producing a coating of two or more coats is that the application of a coating material to a coat already applied beforehand is always undertaken only when that coat has reached at least a dust-dry state. This ensures that the coating materials of the different coats need not be compatible with one another in the liquid state, and allows the very different coating materials in the various coats to be combined with one another. Thus, for example, it is possible to combine aqueous coating materials with solventborne coating materials, or epoxide-based binders with polyurethane-based binders. In the literature, incorrectly, coating methods in which a coating material is applied to an existing coat that has not yet been fully cured are referred to as "wet-on-wet" methods.

Furthermore, so-called "wet-on-wet" products are available commercially for producing a surfacer coat and a topcoat. These products too necessarily require the flashing of the surfacer coat at least to a dust-dry state (but not a thermal cure) before a topcoat can be applied. Here as well, accordingly, the term "wet-on-wet" is misleading and is not applied correctly.

Depending on the desired profile of properties of the multicoat paint system, coating materials for the individual coats can be selected almost independently of one another. The proven finishing methods described above therefore offer very complex possibilities for variation, allowing even highly specific requirements of a multicoat paint system to be met.

In view of the numerous possibilities for variation, however, they also entail numerous possibilities for error, which can be eliminated only by complicated and therefore expensive correction steps. Examples of possible sources of error are errors in surfacer application, which have to be eliminated by sanding of the cured surfacer coat prior to topcoat application. In addition, during the finishing operation, bodies or constituents thereof are held temporarily in buffer zones, as a corollary of the operation, where they may become soiled. A risk inherent in this system is that, for example, of a coating material for forming a topcoat being applied to a surface which has not been adequately cleaned, and the cured topcoat subsequently exhibiting surface defects. These defects must then be eliminated, in turn, at cost and inconvenience.

It was an object of the present invention, accordingly, to provide a new method for producing a multicoat paint system that is distinguished by low complexity and a reduction in possibilities for error. At the same time, the method of the invention is to entail reduced operating times and operating costs. The profile of properties of the resulting multicoat paint system is to be at least comparable with that of the multicoat paint systems produced using the finishing methods known from the prior art. In particular, the multicoat paint systems produced with the method of the invention are to be at least comparable—in terms of their visual properties (appearance, gloss, leveling, etc.) and their technomechanical properties, such as weathering resistance and chemical resistance, for example—with coatings produced by methods from the prior art.

It has been possible to achieve this object by provision of a method for producing a coating, consisting of a cured surfacer coat and topcoat, on a substrate, including i) production of a coating system by i-a) in a first step, applying to the untreated substrate or substrate coated at least with a cured electrodeposition coat, a coating material comprising at least one coloring pigment and comprising at least one self-crosslinking, externally crosslinking, or physically drying binder as main binder, to form a surfacer coat, i-b) in a second step, applying, to the surfacer coat, a further coating material comprising at least one coloring pigment and comprising at least one self-crosslinking, externally crosslinking, or physically drying binder as main binder, to form a topcoat, and ii) the coating system produced in step i) is cured to form the coating, characterized in that the coating materials used in i-a) and i-b) in the coating system are compatible according to DIN EN ISO 12944-5:2008-01, and the application of the coating material to form the topcoat in i-b) takes place before the coating material for forming the surfacer coat in i-a) has reached drying stage 1 according to DIN 53150:2002-09, the drying stage being determined according to EN ISO 9117-3:2010.

The invention further relates to a method for producing a coating, consisting of a cured surfacer coat and topcoat, on a substrate, including i) production of a coating system by i-a) in a first step, applying to the untreated substrate or substrate coated at least with a cured electrodeposition coat, coating material comprising at least one self-crosslinking, externally crosslinking, or physically drying binder as main binder, to form a surfacer coat, i-b) in a second step, applying, to the surfacer coat, a further coating material comprising at least one self-crosslinking, externally crosslinking, or physically drying binder as main binder, to form a topcoat, and ii) the coating system produced in step i) is cured to form the coating, characterized in that the coating materials used in i-a) and i-b) in the coating system are compatible according to DIN EN ISO 12944-5:2008-01, and the application of the coating material to form the topcoat in i-b) takes place before the coating material for forming the surfacer coat in i-a) has reached drying stage 1 according to DIN 53150:2002-09, the drying stage being determined according to EN ISO 9117-3:2010.

Within the meaning of the present specification, the following definitions of terms are introduced:

The term "coating" describes the entirety of the cured coats which have been or are to be applied to a substrate. The term "coat" refers to a continuous coat formed by single or multiple application of a coating material to a substrate. A coat is converted into a cured coat by curing. In the case of a coating which has only one cured coat, the terms coating and cured coat are synonymous.

The term "coating system" refers to the entirety of the coats of coating materials which have been or are to be applied to a substrate.

A coating material is a liquid product which when applied to a substrate produces a coat. After curing, a cured coat is the result of this coat. Where two or more coating materials are applied in succession, to form one coat in each case, the result is a coating system. Where this coating system is cured, the result is a coating consisting of the respective cured coats. In order to simplify the designations, the coating materials for forming the respective coat are also named according to that coat: this means that a coating material for forming the surfacer coat is referred to as surfacer, and a coating material for forming a topcoat is referred to as topcoat.

"Flashing (off)" is the partial evaporation of the volatile fractions of a coating material before film formation is complete and/or a further coating composition is applied. The flashing time is also referred to as flash-off time.

Curing or physical drying is the entire complex of processes, reaction sequences, transformations, and so on, that are associated with the transition of the coating material applied in liquid form into a solid film adhering thoroughly to the substrate. The result of the curing is a crosslinked film. This may be achieved by chemical or physical crosslinking, i.e., the interlooping of polymer chains by complete removal of the solvent.

The general term "binder", according to DIN 4618:2007-03, is the nonvolatile fraction of a coating material without pigments and fillers. The term "solids" describes the nonvolatile fraction of a coating material.

It is essential to the invention that the coating materials used in step i-a) and i-b) are compatible in the coating system according to DIN EN ISO 12944-5:2008-01. Compatibility in the sense of this invention denotes the capacity of two or more coating materials to be used in a coating system without unwanted side effects occurring.

It is further essential to the invention that the application of the coating material for forming the topcoat in i-b) takes place before the coating material for forming the surfacer coat in i-a) has reached drying stage 1 according to DIN 53150:2002-09, the drying stage being determined according to EN ISO 9117-3:2010. According to DIN 53150:2002-09, drying stage 1 is achieved when glass beads of defined size, applied by scattering, can be removed again with a soft animal-hair brush, easily and without residue, and without damaging the surface. The concept of dust dryness as well is used synonymously for the concept of drying stage 1.

In the method of the invention, in step i), first of all a coating system is produced. For this purpose, in step i-a), a coating material comprising at least one coloring pigment is applied to an untreated substrate, or to a substrate coated at least with a cured electrodeposition coat, to form a surfacer coat.

The purpose of the surfacer coat is to level out any unevennesses and/or differences in hue of the substrate. At the same time, this coat, when in the cured state, acts to absorb energy and to protect the underlying substrate surface from UV transmission.

In step i-b), in a second step, a further coating material comprising at least one coloring pigment is applied, to form a topcoat.

It is essential to the invention that the application of the coating material for forming the topcoat takes place to the surfacer coat before the coating material for forming the surfacer coat has reached drying stage 1 according to DIN 53150:2002-09, the drying stage being determined according to EN ISO 9117-3:2010.

A consequence of this is the direct "wet-on-wet" application of the two coating materials, and so there is no discrete boundary layer formed between the surfacer coat and the topcoat. Hence there is automatically intercoat adhesion between the cured surfacer coat and the cured topcoat.

As a corollary of operation, unavoidable flash-off times arise between steps i-a) and i-b), resulting from the cycle times when applying the coating materials and the result, where practiced, of additional operations, such as preliminary coating at critical locations, such as on beads and edges, for example. In contrast to the integrated finishing methods known from the prior art, these unavoidable flash-off times impair the appearance of the resulting coating, and in the method of the invention should therefore be kept as short as possible.

As a result of the application of the coating material for forming the topcoat before the surfacer coat is dust-dry, it is further essential to the invention that the coating materials used in i-a) and i-b) are compatible in the coating system according to DIN EN ISO 12944-5:2008-01. In general this means that no unwanted effects occur when the topcoat is applied to the not yet dust-dry surfacer coat. This means in particular that no negative physical or chemical interactions arise that negatively impact film formation or the properties of the resulting coating. Unwanted effects in the sense of this invention are, in particular, the development of a discrete phase boundary between the surfacer coat and the topcoat, preventing any partial mixing of the surfacer coat and the topcoat. It is undesirable, furthermore, for separation of the respective coating materials to occur, as it can result, for example, in a gradient of the main binder within the coat in question. Other unwanted side effects are the incidence of precipitation in the coating system, as a result, for example, of the formation of solids within the coating system due to (precipitation) reactions of components of the coating material for forming the surfacer coat and components of the coating material for forming the topcoat; instances of transfer of wetting such that, for example, wetting additives of the surfacer coat interact with wetting additives of the topcoat, leading to destabilization of pigments or fillers. In the sense of the present invention, the unwanted effects also include unwanted surface effects of the resulting coating, such as the occurrence of craters, pinholes, or similar defects in the coating, for example.

Following the production of the coating system consisting of surfacer coat and topcoat, the coating system produced is cured in step ii), to form the coating consisting of a cured surfacer coat and cured topcoat. Curing conditions used here are such that joint curing of the compatible coating materials for forming the surfacer coat and the topcoat is possible.

The coating materials for forming the surfacer coat and the topcoat comprise at least one coloring pigment.

Pigments according to DIN EN ISO 4618 are colorants which consist of fine particles which are insoluble in the liquid phase of the coating material and which are used for their optical, protective and/or decorative qualities. The term "colorant" here includes black or white colorants. Preferred pigments are coloring pigments and/or effect pigments and anticorrosion pigments. Effect pigments are those which impart an optical effect, deriving in particular from reflection of light.

Examples of suitable inorganic coloring pigments are white pigments such as zinc white, zinc sulfide or lithopone; black pigments such as carbon black, iron manganese black or spinel black; chromatic pigments such as chromium oxide, chromium oxide hydrate green, cobalt green or ultramarine green, cobalt blue, ultramarine blue or manganese blue, ultramarine violet or cobalt violet and manganese violet, red iron oxide, cadmium sulfoselenide, molybdate red or ultramarine red; brown iron oxide, mixed brown, spinel phases and corundum phases or chromium orange; or yellow iron oxide, nickel titanium yellow, chromium titanium yellow, cadmium sulfide, cadmium zinc sulfide, chromium yellow or bismuth vanadate.

Further, inorganic coloring pigments are silicon dioxide, aluminum oxide, aluminum oxide hydrate, more particularly boehmite, titanium dioxide, zirconium oxide, cerium oxide, and mixtures thereof.

Examples of suitable organic coloring pigments are monoazo pigments, disazo pigments, anthraquinone pigments, benzimidazole pigments, quinacridone pigments, quinophthalone pigments, diketopyrrolopyrrole pigments, dioxazine pigments, indanthrone pigments, isoindoline pigments, isoindolinone pigments, azomethine pigments, thioindigo pigments, metal complex pigments, perinone pigments, perylene pigments, phthalocyanine pigments, or aniline black.

It is generally possible to check the compatibility of two coating materials in a manual test. For this purpose, in the case of unpigmented coating materials, they are mixed in a transparent container. In the case of pigmented coating materials, an extract of the coating materials is prepared that contains no pigments. If, on mixing, the two coating materials form a clear, homogeneous, and stable solution, the coating materials are compatible with one another. By cooling of the mixtures down to −40° C. and evaluation of the transparency in terms of clarity and translucency, it is possible to evaluate the compatibility of any desired mixtures of coating materials or any desired combinations of binders. As well as the temperature, other variable factors include the selected cooling rate, the cooling time and holding time, and the amounts employed. Accordingly, for comparative tests, the variables can be kept constant or sufficiently similar. In addition to visual evaluation, another technical possibility is that of "turbidity measurement" in analogy to photometric techniques. This allows the results to be quantified more effectively.

Compatibility of the coating materials used in i-a) and i-b) is preferably achieved by the main binder of the coating material for forming the surfacer coat being compatible with the main binder of the coating material for forming the topcoat according to DIN EN ISO 12944-5:2008-01. Unwanted side effects in relation to the compatibility of binders are in particular, for the purposes of this invention, in addition to the side effects already recited in terms of the coating materials, that the curing of one main binder does not interfere with the curing of the other main binder such that defects occur in the resulting coating, such as surface defects, for example. In order to illustrate this, the following example is given: The main binders of the coating materials for forming a surfacer coat and a topcoat are miscible very well and without limitation. One main binder contains primarily very reactive primary hydroxyl groups, while the other main binder contains only low-reactivity hydroxyl groups. As a result of the application of the coating material for forming the topcoat to the surfacer coat before the latter has achieved dust dryness, there is a partial mixing of the coating materials and hence also a partial mixing of the main binders, causing the two main binders to be part of the other coat in each case. Curing by chemical crosslinking of the hydroxyl groups of the two main binders would take place very differently in terms of time, resulting in a very uneven surface.

Compatibility is preferably achieved by the main binders of both coating materials being cured in the same way. This means first of all that both coating materials, or the main binders present therein, are preferably alternatively physically curing or self-crosslinking or externally crosslinking. With particular preference the main binders of the surfacer and of the topcoat are externally crosslinking.

In the case of physically drying coating materials, it is preferred for the physical drying to be able to be carried out under similar conditions. The drying conditions include factors such as the temperature and the drying time. In addition, a key part may be played by the relative air humidity and also by the volume flow conveyed past the coating materials.

For example, similar conditions for the physical drying may be achieved by similar temperatures. Similar temperatures in relation to physical curing mean that the curing temperatures of the coating materials differ preferably by not more than 30° C., more preferably 20° C., very preferably 5° C. It is especially preferred for the temperatures at which the surfacer and the topcoat dry physically to be identical.

It is also especially preferred for the drying conditions in general under which surfacer and topcoat dry physically to be identical.

Where coating materials that comprise self-crosslinking binders as their main binders are used for forming the surfacer coat and the topcoat, it is preferred for these coating materials to cure under similar curing conditions. In the case of self-crosslinking binders, for example, it is possible that they have one or more blocked crosslinker components which undergo deblocking at elevated temperatures to form a reactive crosslinker component. In this case it is preferable for the crosslinker components of the main binders to have similar deblocking conditions, particularly with regard to deblocking temperature and time. It is especially preferred for the curing temperature of the surfacer and of the topcoat to be identical. Self-crosslinking binders may also be cured, for example, by exposure to actinic radiation. In that case it is preferred for the radiation required to cure the binders present in the coating materials to be situated within a similar wavelength range.

Where binders which are externally crosslinking are used as main binders in the coating materials, it is preferable for the ratio of the reactive groups of the crosslinker component to the reactive groups of the component to be crosslinked to be similar in the main binder of both coating materials. Similar in this context means that the ratio of the reactive groups to one another differs preferably by not more than 20%, more preferably 10%, very preferably 5%. With very particular preference, the ratio of the reactive groups of the crosslinker component to the reactive groups of the component to be crosslinked in the binders is identical. It is further preferred for the reactive groups of the crosslinker components and also the reactive groups of the components to be crosslinked in the binders of the coating materials to be extremely similar chemically, and more preferably chemically identical. The above-described preferred versions show by way of example how compatibility can be achieved between the main binders of the coating materials for producing the surfacer coat and the topcoat. Compatibility of the main binders of the two coating materials is preferably achieved by the main binder of the coating material for forming the surfacer coat belonging to the same binder class as the main binder of the coating material for forming the topcoat.

In the context of this invention, the concept of binder class means that the main binders belong to the same chemical compound class. Examples of chemical compound classes in the sense of this invention are polycondensation resins, such as alkyd resins, saturated and unsaturated polyester resins, polyamides, polyimides, silicone resins, and also crosslinker resins, such as phenolic resins and urea resins. Furthermore, the polyaddition resins, such as polyurethanes or epoxy resins, for example, and addition-polymerization resins, such as polyolefins, polyvinyl compounds or poly(meth) acrylates, for example, constitute a chemical compound class.

The main binders of the coating materials are preferably selected from the group consisting of isocyanate-crosslinking, polyhydroxyl group-containing polyester resins and polyacrylate resins and mixtures thereof, more preferably from polyhydroxyl group-containing polyacrylate resins.

It is especially preferred for the main binders of the coating materials for producing the surfacer coat and the topcoat to be identical.

The coating materials for forming the surfacer coat and the topcoat preferably comprise, as solvents, substantially organic solvents or are substantially aqueous, with the coating materials dependently on one another comprising, as solvents, either substantially organic solvents or being substantially aqueous. Here it should generally be ensured that the solvents are unreactive under the selected reaction conditions or have a reactivity with the reaction partners that is negligible, and that the reactants and the reaction products are at least partly soluble therein.

The expression "comprise substantially organic solvents" in connection with the method of the invention is a reference preferably to those coating materials which, as solvents, comprise organic solvents as main component and are therefore substantially free of water. Possibly, however, the coating materials may include water in small fractions. The fraction of water is preferably not more than 1.0 wt %, more preferably not more than 0.5 wt %, very preferably not more than 0.1 wt %, more particularly not more than 0.01 wt %, based in each case on the total fraction of solvents present in the coating materials. Examples of organic solvents include heterocyclic, aliphatic or aromatic hydrocarbons, mono- or polyfunctional alcohols, ethers, esters, ketones, and amides, such as, for example, N-methylpyrrolidone, N-ethylpyrrolidone, dimethyl-formamide, toluene, xylene, butanol, ethyl glycol and butyl glycol and their acetates, butyl diglycol, diethylene glycol dimethyl ether, cyclohexanone, methyl ethyl ketone (MEK), methyl isobutyl ketone (MIBK), acetone, isophorone, or mixtures thereof. With particular preference the organic solvents are selected from the group consisting of 2-heptanone (MAK), butyl glycol acetate (BGA), butyl acetate, and mixtures thereof.

The term "substantially aqueous" in connection with the method of the invention is a reference preferably to those coating materials which as solvents comprise water as main component and therefore are substantially free from organic solvents. Possibly, however, the coating materials may comprise at least one organic solvent in small fractions. Examples of such organic solvents are the organic solvents already listed above. The fraction of the organic solvents is preferably not more than 1.0 wt %, more preferably not more than 0.5 wt %, very preferably not more than 0.1 wt %, more particularly not more than 0.01 wt %, based in each case on the total fraction of the solvents present in the coating materials.

It is particularly preferred for the coating materials for forming the surfacer coat and the topcoat to comprise, as solvents, substantially organic solvents. It is further preferred here for the coating materials to comprise similar solvents or solvent mixtures, more preferably identical solvents or solvent mixtures. Similarity of the solvents or of their mixtures means in particular that they have a similar polarity.

It is especially preferred for both the main binders and the solvents of the coating materials for forming the surfacer coat and the topcoat to be identical.

The coating material for forming the surfacer coat preferably comprises fillers.

Fillers, according to DIN EN ISO 4618, are materials in granular or powder form which are insoluble in the liquid phase of a coating material and are used in order to achieve or influence defined physical qualities. Since there may be instances of overlap between pigments and fillers in terms of their intended use, the refractive index is often employed to distinguish between them. For fillers, the refractive index is below 1.7, meaning that this class of product does not achieve any notable scattering and hiding power.

The coating materials for forming the surfacer coat and the topcoat preferably each have a solids fraction of at least 40 wt %, more preferably of at least 50 wt %, very preferably of 65 wt %. This means that the coating materials used for forming the surfacer coat and the topcoat are preferably what are called high-solids (HS) or, more preferably, ultra-high-solids (UHS) coating materials. Through the preferably high solids content it is possible to ensure application of the desired film thicknesses with one spray pass.

A definition with general validity for the terms MS (medium solids), HS (high solids) or UHS (ultrahigh solids) does not exist. In the case of finishing units without thermal cleaning of outgoing air (incineration), the solvent content in spray-ready mixtures ought to be kept as low as possible for reasons of environmental protection. Within the EU (but in other regions as well), therefore, different limits have been drawn up according to the field of application, for approval of operation of such units. Under this definition, MS coatings have a VOC>420 g/l, HS<420 g/l and UHS<350 g/l. The determination is made, for example, according to DIN EN ISO 11890 or ASTM D2369, and is calculated according to the following formula:

*VOC* (g/l)=(mass of volatile fractions [g]−mass of water [g])/(volume of coating material [l]−volume of water [l]), an organic compound being classed as volatile if it has a vapor pressure of 0.01 kPa at 293.15 K.

Given that the water fraction is subtracted each time and the reference point is the volume of the water-free coating material, the emissions become comparable for the same application (application efficiency, number of spray passes, etc.) and the same area finished, even with coating materials differing in their pigmentation. A corresponding definition applies to the present invention.

The coating materials for forming the surfacer coat and the topcoat are preferably rheology-optimized in that they exhibit sufficient run stability and pop stability. This is achieved preferably by the use of rheological agents and optionally defoamers. Examples of rheological agents which can be used preferably in the method of the invention for controlling the rheological properties of the coating materials are fumed silicas, bentonites, and urea-functionalized polymers.

The application of the coating material for forming the surfacer coat and of the coating material for forming the topcoat takes place preferably by pneumatic and/or electrostatic spraying (ESTA). These operations may be supplemented by manual operations, for the preliminary finishing of critical points, for example.

The coating materials for forming the surfacer coat and the topcoat are preferably each applied at a wet film thickness so as to result in a dry film thickness of 25 to 35 μm for the cured surfacer coat and a dry film thickness of 40 to 80 μm for the cured topcoat.

The dry film thickness of the cured surfacer coat and of the cured topcoat is determined microscopically by means of transverse sections. For this purpose, the cured coats produced are parted from the substrate using suitable tools, such as with a scalpel, for example. The film sections thus obtained are fastened in a slide holder to allow the coating to be microscoped (transverse section, so-called). By appropriately calibrated microscopy in conjunction with image analyses, film thickness determinations can be carried out to an accuracy of plus/minus 1 μm.

The method of the invention is especially suitable for producing coatings on automobiles and commercial vehicles, such as trucks, vans, or buses. The substrate is therefore preferably a body or a cabin of a motor vehicle or a part thereof. More preferably the substrate is a body or a cabin of an automobile or commercial vehicle, more particularly of trucks, vans, or buses.

The present invention further relates to a substrate coated with a coating consisting of a cured surfacer coat and a cured topcoat, the coating having been produced by the method of the invention.

The observations above show that the complexity involved in producing a coating can be reduced massively by the method of the invention. Accordingly, for example, in the case of two-component coating materials using an identical crosslinker component in the surfacer and in the topcoat, the method of the invention makes it possible, with regard to plant technology, to do without an additional separate conduit for the crosslinker component. Furthermore, the coating materials for forming the surfacer coat and for forming the topcoat can be processed on one unit. As a result, a substantial expansion to capacity is possible through the omission of a separate line for applying the surfacer coat, thereby permitting a significant reduction to be realized in the capital investment costs per unit coated surface area.

The targeted reduction in possibilities for error, in operating times, and in operating costs is achieved through the omission of operating steps susceptible to errors. Omitted accordingly are the flashing or curing of the surfacer coat in the oven, the possible need for corrective sanding of the cured surfacer coat, the interim storage of a body or parts thereof, coated with a surfacer coat, in buffer zones, and the possible need for cleaning thereof prior to application of the coating material for forming the topcoat. As a result it is possible to reduce surface defects caused by improper application and/or by suboptimal matching of the coating materials such as, for example, the development of pops in solvent-based topcoats resulting from water from an inadequately flashed or dried aqueous surfacer coat. The method of the invention also minimizes the incidence of wetting defects (craters) on substrates with low surface energy.

The coatings produced with the method of the invention exhibit a profile of properties which is at least comparable with that of coatings produced according to methods known from the prior art. In comparison to the coats each coated individually with the same coating materials and baked, coatings produced by the method of the invention exhibit significantly better appearance, including, for example, on vertical faces.

The present invention is additionally elucidated hereinafter by the examples which follow.

Unless otherwise stated, amounts in parts are parts by weight, and amounts in percent are percentages by weight.

Unless indicated otherwise herein, all indications of standards refer to the standard current on the filing date of the present invention.

ABBREVIATIONS AND STARTING MATERIALS

TNP 1,1,1-tris(hydroxymethyl)propane
HHPAn hexahydrophthalic anhydride
Cardura E10® glycidyl ester of neodecanoic acids; manufacturer: Momentive
HDI hexamethylene diisocyanate
IPDI isophorone diisocyanate The nonvolatile fraction, i.e., the solids content (solids fraction), of the coating materials is determined according to DIN EN ISO 3251 (date: June 2008). The test duration for this is 60 minutes at a temperature of 130° C. The nonvolatile fraction which remains after drying is expressed in relation to the initial mass, and indicates the percentage solids content of the coating material composition.

Determination of the OH Number: The OH number is calculated via the stoichiometry of the components used. The OH number is calculated from the OH-functional components employed minus the acid number attained, plus the further OH groups arising from the ring-opening reaction.

Determination of the acid number: The acid number is determined by titration with a KOH solution according to DIN EN ISO 2114. The acid number here indicates the amount of potassium hydroxide in mg which is consumed in the neutralization of 1 g of the respective compound.

The reported OH numbers and acid numbers relate in each case to the solids fraction of the coating material.

Determination of the molecular weight: Molecular weight determinations are carried out by means of gel permeation chromatography (GPC) at 40° C. using a high-pressure liquid chromatography pump and a refractive index detector. Eluent used is tetrahydrofuran, with an elution rate of 1 ml/min. Calibration is carried out using a polyMMA standard. The number-average molecular weight Mn, the weight-average molecular weight Mw, and Mp are determined, with the polymolecularity index Mp being calculated from Mp=Mw/Mn.

Determination of the glass transition temperature $T_g$ is carried out according to DIN 53765.

The measurement of the viscosity was carried out at 23° C. using a rotational viscometer from Brookfield, model CAP 2000+, spindle 3 with a shear rate of 1250 $s^{-1}$.

In the working examples below, application took place in each case by ESTA to cathodically electrocoated substrate; dry film thicknesses: surfacer 30 μm in each case, topcoat 50 μm in each case.

Prior art: Comparative example sample 1 with a commercial surfacer (surfacer 1) and a commercial white two-component topcoat (topcoat 1) (both from BASF Coatings GmbH Münster):

Surfacer 1 is a one-component (1-K) waterborne surfacer based on a polyester, crosslinked with a melamine resin. An alternative possibility is to use commercial solventborne fillers, such as polyamine-crosslinked epoxy resins or oligoisocyanate-crosslinked OH-functional acrylate resins, for example.

Topcoat 1 is a two-component (2-K) topcoat (white) based on an OH-functional acrylate resin which has been crosslinked with oligoisocyanate (similar in composition to the topcoat composition of topcoat 2).

Filler and topcoat for the inventive method: 2-K surfacer (surfacer 2) and 2-K topcoat (white) (topcoat 2)

Description of the Individual Syntheses for Producing the Binder Composition for the Working Example in the Inventive Method:

Polyester:

Analogous: reference: Research Disclosure (2006), 505 (May), P520-P521 (No. 505044) CODEN: RSDSBB; ISSN: 0374-4353

In analogy to example A from the literature reference identified above, 1 mol of TNP is reacted with 2 mol of HHPAn, and then the resulting product is reacted in a second stage with 2 mol of Cardura E10 at 120° C. After a further 2 hours at this temperature, the product is cooled and diluted with a mixture of 2 parts xylene and 1 part SOLVENTNAPHTHA 160/180 to a solids content of 84±1%. This gives a viscous solution having a viscosity of 3400-4800 mPas.

OH-Functional Acrylate 1:

OH-functional acrylate polymerized in SOLVENTNAPHTHA 160/180 with an OH number of 115-125 mg KOH/g, a $T_g$ of 33° C., an acid number of 5-8 mg KOH/g, a number-average molecular weight of 1200-2000 daltons, and a weight-average molecular weight of 3300-5100 daltons (measured against polymethyl methacrylate as standard), and a solids content of 65±1%. The polymerization temperature is 160° C. under superatmospheric pressure (3 bar abs.).

The solvent is a mixture of SOLVENTNAPHTHA 160/180 and n-butyl acetate in a ratio of 4:1. The OH acrylate has a viscosity of 650-1000 mPas. The monomer composition is composed of approximately equal parts of styrene, hydroxyethyl methacrylate, methyl methacrylate, and isodecyl methacrylate.

OH-Functional Acrylate 2:

OH-functional acrylate polymerized in butyl acetate with an OH number of 152-160 mg KOH/g, a $T_g$ of 55° C., an acid number of 8-10 mg KOH/g, a number-average molecular weight of 1600-2200 daltons, and a weight-average molecular weight of 3900-4500 daltons (measured against polymethyl methacrylate as standard), and a solids content of 55±1%. The solvent is a mixture of SOLVENTNAPHTHA 160/180 and n-butyl acetate in a ratio of 7:1.

The OH acrylate has a viscosity of 900-1300 mPas. The monomer composition consists of equal parts of styrene, butyl methacrylate, hydroxyethyl methacrylate, hydroxypropyl methacrylate, and also cyclohexyl methacrylate and a small fraction of acrylic acid.

OH-Functional Acrylate 3:

OH-functional acrylate polymerized in butyl acetate with an OH number of 115-125 mg KOH/g, a $T_g$ of 33° C., an acid number of 5-8 mg KOH/g, a number-average molecular weight of 1300-1500 daltons, and a weight-average molecular weight of 3700-4500 daltons (measured against polymethyl methacrylate as standard), and a solids content of 78±1% in butyl acetate. The polymerization temperature is 160° C. under superatmospheric pressure (3 bar abs.).

This gives a viscous solution having a viscosity of 5800-6300 mPas. The monomer composition is composed of approximately equal parts of styrene, hydroxyethyl methacrylate, methyl methacrylate, and isodecyl methacrylate.

Working Example of a Surfacer Formulation and a Topcoat Formulation for the Inventive Method (Surfacer 2 and Topcoat 2)

| | Surfacer 2 | Topcoat 2 |
|---|---|---|
| Polyester (solid) | 15.5 | 16 |
| OH acrylate resin 1 and 2 (solid) | 10 | 13.1 |
| OH acrylate resin 3 (solid) | 11 | 9.4 |
| Commercial dispersing additives (Disperbyk from Byk) | 1 | 0.8 |
| Filler 1 Talc | 5 | 0 |
| Filler 2 Chalk | 16 | 0 |
| Filler 3 Zinc oxide | 12 | 0 |
| Pigment 1 Titanium dioxide | 3 | 33.7 |
| Pigment 2 Carbon black | 0.01 | 0.2 |
| Additives (light stabilizer, UV absorber, HALS) | 0 | 0.5 |
| Thixotropic additive 1 Aerosil | 0.1 | 0.2 |
| Thixotropic additive 2 Bentone | 0.3 | 0.2 |
| Catalyst | 0.02 | 0.02 |
| Solvents Acetates, ketones, aromatics, aliphatics | 25 | 25.83 |
| Additives (flow control, wetting) | 0.07 | 0.05 |
| | 100 | 100 |

Both surfacer and topcoat were crosslinked with a commercial aliphatic oligoisocyanate based on hexamethylene diisocyanate (HDI). Alternatively, crosslinking can also be carried out with isophorone diisocyanate (IPDI).

The application itself was made in each case under identical conditions, with ESTA (electrostatic application), from the same distance, with the same delivery rates, drawing speeds, rotary speed of the bell, etc.

Inventive Samples:

In inventive examples 2, 3 and 4, the coating material for forming the topcoat is applied before the coating material for forming the surfacer coat has reached drying stage 1 according to DIN 53150:2002-09. The samples differ in the flash-off time of the surfacer coat.

Comparative Samples with Surfacer 1 or Surfacer 2:

The topcoat was applied, after curing of the surfacer, to the respective cured surfacer coat.

Sample 1: Surfacer 1 cured thermally before topcoat application

Sample 5: Surfacer 2 cured thermally before topcoat application

| Sample | 1* | 2 | 3 | 4 | 5* |
|---|---|---|---|---|---|
| Surfacer | Surfacer 1 | Surfacer 2 | Surfacer 2 | Surfacer 2 | Surfacer 2 |
| Flash-off time of surfacer coat | | 240 sec | 480 sec | 600 sec | |
| Curing of surfacer coat | x | | | | x |
| Topcoat | Topcoat 1 | Topcoat 2 | Topcoat 2 | Topcoat 2 | Topcoat 2 |
| LW | 5.6 | 3.4 | 5.4 | 7.2 | 17.5 |
| SW | 3.6 | 5.4 | 6.5 | 6.9 | 2.3 |
| N1 | 4.9 | 3.6 | 4.8 | 5.5 | 8 |
| N3 | 5.2 | 3.8 | 5.1 | 5.8 | 8.3 |
| CF | 63.5 | 70.2 | 64.4 | 60.6 | 44.6 |
| DOI | 93.1 | 93.3 | 93.2 | 93 | 93.6 |

*not inventive

With noninventive combination of surfacer 1 with topcoat 1 or 2 (not listed in the table) and with application of the topcoats to the surfacer coat before the latter has achieved dust dryness, after the flash-off times reported in the table, matt topcoat surfaces were obtained. This represents an unwanted side effect. The surface properties of a matt surface cannot be measured using a wave-scan instrument.

The optical properties were measured using a commercial wave-scan dual instrument from Byk Gardner. The values obtained therewith on glossy surfaces were converted, by the accompanying software, into the following values:

Longwave (LW), shortwave (SW)

N1 and N3 (according to BMW scales, which represent the surface as viewed from a distance of 1 m and 3 m respectively)

CF (according to FORD scales, which are made up of luster, sharpness, and orange peel)

DOI (corresponding approximately to the gloss at a 20° viewing angle)

With regard to the evaluation of the optical result, better optical properties are present when LW and SW are smaller and/or when LW<SW N1 and N3 are smaller CF is greater The results table shows that sample 2 (inventive combination of surfacer 2 and topcoat 2 with the shortest flash-off time) exhibits the best optical properties. An extension to the flash-off time causes deterioration in the optical properties, contrary to the existing experience with known methods from the prior art. Overall it is found that all inventive samples exhibit good optical properties. In particular, the coatings produced by the method of the invention display the best results in terms of gloss and leveling.

What is claimed is:

1. A method for producing a coating, consisting of a cured surfacer coat and a cured topcoat, on a substrate, the method comprising:

producing a coating system by first applying a first coating material to an untreated substrate or a substrate coated at least with a cured electrodeposition coat, thereby forming a surfacer coat, wherein the first coating material comprises a coloring pigment and at least one of the group consisting of a self-crosslinking, an externally crosslinking, and a physically drying binder, as a main binder, and second applying a second coating material to the surfacer coat, thereby forming a topcoat, wherein the second coating material comprises a coloring pigment and at least one of the group consisting of a self-crosslinking, an externally crosslinking, and a physically drying binder, as a main binder, and curing the coating system to form the coating, wherein the first and second coating materials used in the coating system are compatible according to DIN EN ISO 12944-5:2008-01, wherein the second applying takes place before the first coating material has reached drying stage 1 according to DIN 53150:2002-09, the drying stage being determined according to EN ISO 9117-3:2010, wherein the first and second coating materials in the coating system are different, and wherein the main binder of the first and second coating materials is at least one selected from the group consisting of an isocyanate-crosslinking, polyhydroxyl group-containing polyester and a polyacrylate resin.

2. The method of claim 1, wherein the main binder of the first coating material and the main binder of the second coating material are compatible according to DIN EN ISO 12944-5:2008-01.

3. The method of claim 1, wherein the main binder of the first coating material and the main binder of the second coating material are from the same binder class.

4. The method of claim 1, wherein the main binder of the first coating material and the main binder of the second coating material are identical.

5. The method of claim 1, wherein the first and second coating materials comprise, as solvents, substantially organic solvents or are substantially aqueous.

6. The method as claimed in claim 5, wherein the first and second coating materials comprise, as solvents, substantially organic solvents.

7. The method of claim 1, wherein both the main binders and the solvents of the first and second coating materials are identical.

8. The method of claim 1, wherein the first and second coating materials have a solids fraction of at least 40 wt %.

9. The method of claim 1, wherein the first coating material and the second coating material are applied by pneumatic spraying and/or electrostatic spraying.

10. The method of claim 1, wherein the first and second coating materials are each applied with a wet film thickness such that a dry film thickness of the cured surfacer coat is 25 to 35 μm and a dry film thickness of the cured topcoat is 40 to 80 μm.

11. The method of claim 1, wherein the substrate is a body of a motor vehicle or a part of the body of the motor vehicle.

12. A substrate coated with a coating consisting of a cured surfacer coat and a cured topcoat, produced by the method of claim 1.

13. The method of claim 1, wherein the first coating material comprises at least one filler.

14. The method of claim 1, wherein there is no discrete boundary layer formed between the surfacer coat and the topcoat in the coating system.

15. The method of claim 1, wherein there is an intercoat adhesion between the cured surfacer coat and the cured topcoat in the coating system.

* * * * *